US008605030B2

(12) United States Patent
Kang et al.

(10) Patent No.: US 8,605,030 B2
(45) Date of Patent: Dec. 10, 2013

(54) METHOD OF PREVENTING THE TEMPERATURE OF A BACKLIGHT SOURCE FROM REMAINING AT A LOW TEMPERATURE BASED ON THE DUTY RATIO HISTORY OF THE BACKLIGHT

(75) Inventors: Hyung-Ku Kang, Seoul (KR); Hyuk-Hwan Kim, Asan-si (KR); Dae-Gwang Jang, Incheon (KR); Yu-Han Bae, Seoul (KR); Hyeon-Yong Jang, Osan-si (KR)

(73) Assignee: Samsung Display Co., Ltd. (KR)

( * ) Notice: Subject to any disclaimer, the term of this patent is extended or adjusted under 35 U.S.C. 154(b) by 1022 days.

(21) Appl. No.: 12/473,815

(22) Filed: May 28, 2009

(65) Prior Publication Data

US 2010/0141672 A1 Jun. 10, 2010

(30) Foreign Application Priority Data

Dec. 9, 2008 (KR) ..... 10-2008-0124470

(51) Int. Cl.
*G09G 3/36* (2006.01)

(52) U.S. Cl.
USPC ..... 345/102

(58) Field of Classification Search
USPC ..... 345/102, 211–215
See application file for complete search history.

(56) References Cited

U.S. PATENT DOCUMENTS

| | | | | |
|---|---|---|---|---|
| 5,907,742 | A * | 5/1999 | Johnson et al. | 399/51 |
| 2002/0067332 | A1* | 6/2002 | Hirakata et al. | 345/102 |
| 2004/0130521 | A1* | 7/2004 | Kim | 345/102 |
| 2005/0012468 | A1* | 1/2005 | Ryu et al. | 315/274 |
| 2006/0279523 | A1* | 12/2006 | Nitta et al. | 345/102 |
| 2007/0052664 | A1* | 3/2007 | Hirakata et al. | 345/102 |
| 2007/0057902 | A1* | 3/2007 | Joung | 345/102 |
| 2007/0120505 | A1* | 5/2007 | Moriyasu et al. | 315/309 |
| 2008/0136770 | A1* | 6/2008 | Peker et al. | 345/102 |
| 2008/0238860 | A1* | 10/2008 | Onodera | 345/102 |
| 2008/0272996 | A1* | 11/2008 | Wu | 345/87 |
| 2009/0015541 | A1* | 1/2009 | Honbo | 345/102 |
| 2009/0015601 | A1* | 1/2009 | Kim | 345/690 |
| 2009/0073343 | A1* | 3/2009 | Kojima et al. | 349/61 |

FOREIGN PATENT DOCUMENTS

| | | | | |
|---|---|---|---|---|
| JP | 09288262 | A * | 11/1997 | G02F 1/133 |
| JP | 2006-030416 | A | 2/2006 | |
| JP | 2006-351319 | A | 12/2006 | |
| KR | 1020060117737 | A | 11/2006 | |

* cited by examiner

*Primary Examiner* — Chanh Nguyen
*Assistant Examiner* — Navin Lingaraju
(74) *Attorney, Agent, or Firm* — Cantor Colburn LLP

(57) ABSTRACT

A light source device includes a light source module having a light-emitting block, an image analysis part, a duty ratio calculation part, a duty ratio determination part and a signal generation part. The image analysis part extracts representative luminance data of the light-emitting block based on pixel data. The duty ratio calculation part calculates duty ratio data of the light-emitting block based on the representative luminance data. The duty ratio determination part generates determined duty ratio data of the light-emitting block based on the duty ratio data from a first period, and the signal generation part generates a driving signal having a duty ratio corresponding to the determined duty ratio data to drive the light-emitting block.

11 Claims, 8 Drawing Sheets

DUTY RATIO VARIATION OF FIRST LIGHT-EMITTING BLOCK

DUTY RATIO VARIATION OF FIRST LIGHT-EMITTING BLOCK

METHOD OF PREVENTING THE TEMPERATURE OF A BACKLIGHT SOURCE FROM REMAINING AT A LOW TEMPERATURE BASED ON THE DUTY RATIO HISTORY OF THE BACKLIGHT

This application claims priority to Korean Patent Application No. 2008-124470, filed on Dec. 9, 2008, and all the benefits accruing therefrom under 35 U.S.C. §119, the contents of which in its entirety are herein incorporated by reference.

BACKGROUND OF THE INVENTION

1. Field of the Invention

The present invention relates to a light source device, a display apparatus having the light source device and a method of operating the light source device. More particularly, the present invention relates to a light source device providing a substantially improved display quality of a display apparatus, the display apparatus having the light source device, and a method of operating the light source device.

2. Description of the Related Art

Typically, a liquid crystal display ("LCD") apparatus includes an LCD panel and a backlight assembly disposed under the LCD panel. The LCD panel displays an image by controlling an optical transmittance of liquid crystal molecules in the LCD panel. The backlight assembly provides the LCD panel with light.

The LCD panel includes a lower substrate, an upper substrate and a liquid crystal layer interposed between the lower substrate and the upper substrate. The lower substrate has a pixel electrode and a thin-film transistor ("TFT") electrically connected to the pixel electrode. The upper substrate has a common electrode. The liquid crystal layer includes liquid crystal molecules. An arrangement of the liquid crystal molecules is controlled by an electric field applied between the pixel electrode and the common electrode, and an optical transmittance of the liquid crystal layer is thereby controlled. When the optical transmittance of the liquid crystal layer is at a maximum, the LCD panel displays a white image having a high luminance. Conversely, when the optical transmittance of the liquid crystal layer is at a minimum, the LCD panel displays a black image having a low luminance.

To increase an amount of light passing through the LCD panel while reducing an amount of light generated from a backlight module, a dimming technology has been developed. The dimming technology includes a light emitting diode module having light emitting diodes, and is utilized in a lamp module having a lamp. A one-dimensional dimming technology is applied to the lamp module because of linear characteristics of the lamp. In the one-dimensional dimming technology, a light source is divided into linear light-emitting blocks, and image data in image sections corresponding one-to-one to the light-emitting blocks is analyzed to extract luminance data. The light-emitting block is driven by a driving signal based on the luminance data. The LCD panel compensates pixel data using the luminance data.

However, when the lamp operates at a low luminance for an extended period of time, the lamp cools down to a relatively low temperature, and subsequently, a rapidly changing image does not have sufficiently high luminance. On the other hand, when the lamp operates at a high luminance for an extended period of time, the lamp heats up to a relatively high temperature, and a subsequent rapidly changing image does not have sufficient luminance. Therefore, an undesirable luminance imbalance occurs.

BRIEF SUMMARY OF THE INVENTION

Exemplary embodiments of the present invention provide a light source device having substantially improved luminance characteristics which vary according to a temperature of a light source of the light source device.

Exemplary embodiments of the present invention further provide a display apparatus having the light source device.

Exemplary embodiments of the present invention also provide a method of driving the light source device.

In accordance with an exemplary embodiment, a light source device includes a light source module, an image analysis part, a duty ratio calculation part, a duty ratio determination part and a signal generation part. The light source module includes a light-emitting block. The image analysis part extracts representative luminance data of the light-emitting block based on pixel data. The duty ratio calculation part calculates duty ratio data of the light-emitting block based on the representative luminance data. The duty ratio determination part generates determined duty ratio data of the light-emitting block based on the duty ratio data from a first period. The signal generation part generates a driving signal having a duty ratio corresponding to the determined duty ratio data to drive the light-emitting block.

In an exemplary embodiment, the predetermined duty ratio data is a predetermined high duty ratio applied to the light-emitting block during a second period, subsequent to the first period, when the duty ratio data of the light-emitting block is less than a predetermined value during the first period. Alternatively, the predetermined duty ratio data is the duty ratio data of the light-emitting block when the duty ratio data of the light-emitting block is greater than or equal to the predetermined value during the first period.

In accordance with another exemplary embodiment, a display apparatus includes a display panel, a light source module, a light source driving device, a compensation part and a panel driving part. The display panel displays an image, and light source module includes a light-emitting block and provides the display panel with light. The light source driving device calculates duty ratio data of the light-emitting block based on pixel data, is configured to generate determined duty ratio data based on the duty ratio data from a first period, and is further configured to drive the light-emitting block by supplying a driving signal having a duty ratio corresponding to the determined duty ratio data. The compensation part receives the driving signal from the light source driving device and generates compensated pixel data by compensating the pixel data of an image block corresponding to the light-emitting block based on the driving signal having the duty ratio corresponding to the determined duty ratio data. The panel driving part drives the display panel based on the compensated pixel data.

In an exemplary embodiment, the light source driving device includes: an image analysis part which extracts representative luminance data of the light-emitting block based on the pixel data; a duty ratio calculation part which calculates the duty ratio data of the light-emitting block based on the representative luminance data; a duty ratio determination part which generates the determined duty ratio data of the light-emitting block based on the duty ratio data from the first period; and a signal generation part which generates the driving signal having the duty ratio corresponding to the determined duty ratio data to drive the light-emitting block.

In an exemplary embodiment, the predetermined duty ratio data is a predetermined high duty ratio applied to the light-emitting block during a second period, subsequent to the first period, when the duty ratio data of the light-emitting block is less than a predetermined value during the first period, and the compensation part generates the compensated pixel data using the predetermined high duty ratio of the predetermined duty ratio data. Alternatively, the predetermined duty ratio data is the duty ratio data of the light-emitting block when the duty ratio data of the light-emitting block is greater than or equal to the predetermined value during the first period, and the compensation part generates the compensated pixel data using the duty ratio data of the light-emitting block.

In accordance with still another exemplary embodiment, a method of driving a light source device, the light source device including a light source module having a light-emitting block, includes: extracting representative luminance data of the light-emitting block by using pixel data; calculating duty ratio data of the light-emitting block by using the representative luminance data; generating a determined duty ratio of the light-emitting block the based on the duty ratio data from a first period; generating a driving signal having a duty ratio corresponding to the determined duty ratio data; and driving the light-emitting block using the driving signal.

In an exemplary embodiment, the generating the determined duty ratio data includes: determining whether the duty ratio data is less than a predetermined value during the first period; and generating the determined duty ratio data as a high duty ratio for the light-emitting block during a second period, subsequent to the first period, when the duty ratio data is less than the predetermined value during the first period.

In an exemplary embodiment, the generating the determined duty ratio data further comprises generating the determined duty ratio data as duty ratio data when the duty ratio data is greater than or equal to the predetermined value during the first period.

In accordance with still another exemplary embodiment, a method of driving a light source device including a light source module having a light-emitting block includes: determining duty ratio data of the light-emitting block by using pixel data; extracting fixed duty ratio data based on the duty ratio data from a first period; calculating fixed luminance data corresponding to a temperature of the light-emitting block by using the fixed duty ratio data; generating a driving signal having a duty ratio corresponding to the duty ratio data; and driving the light-emitting block with the driving signal.

In an exemplary embodiment, the calculating the fixed luminance data comprises linear interpolation using the duty ratio data and the fixed duty ratio data.

In an exemplary embodiment, the fixed luminance data is calculated by:

$$\Delta_{SAT} = PWM_{SAT} - (PWM_{SAT}\%10) \times 10$$

$$\Delta_{OUT} = PWM_{OUT} - (PWM_{OUT}\%10) \times 10$$

$$E = C + \frac{\Delta_{SAT}}{A - C}$$

$$F = D + \frac{\Delta_{OUT}}{F - E}$$

$$G = E + \frac{\Delta_{OUT}}{F - E}$$

where: $\Delta_{SAT}$ is a deviation of the fixed duty ratio data, $\Delta_{OUT}$ is a deviation of the duty ratio data, $PWM_{SAT}$ represents the fixed duty ratio data, $PWM_{SAT}\%10$ represents a quotient of the fixed duty ratio data divided by 10, $PWM_{OUT}$ represents the duty ratio data, $PWM_{OUT}\%10$ represents a quotient of the duty ratio data divided by 10, A and B are luminance data corresponding to a fixed duty ratio data greater than the fixed duty ratio data, C and D are luminance data corresponding to a fixed duty ratio data less than the fixed duty ratio data, E and F are luminance data corresponding to the fixed duty ratio data, and G is the fixed luminance data.

In accordance with still another exemplary embodiment, a light source device includes: a light source module including a light-emitting block; a duty ratio determination part which determines duty ratio data by using representative luminance data of the light-emitting block based on pixel data; a fixed duty ratio extracting part which extracts fixed duty ratio data based on the duty ratio data from a first period; a fixed luminance calculation part which calculates fixed luminance data corresponding to a temperature of the light-emitting block based on the fixed duty ratio data; and a signal generation part which generates a driving signal having a duty ratio corresponding to the determined duty ratio data to drive the light-emitting block.

In an exemplary embodiment, the light source device further includes a duty ratio storage part which stores the duty ratio data during the first period, wherein the duty ratio storage part periodically stores most significant J-bit data of the duty ratio data every I frames (where I and J are natural numbers) during the first period.

In an exemplary embodiment, the fixed luminance calculation part includes a storage part which stores luminance data corresponding to duty ratio data sampled from measured fixed duty ratio data, and the fixed luminance calculation part calculates the fixed luminance data by linear interpolation of the measured fixed duty ratio data.

In accordance with still another exemplary embodiment, a display apparatus includes: a display panel which displays an image; a light source module including a light-emitting block and which provides the display panel with light; a light source driving device which extracts fixed duty ratio data based on duty ratio data of the light-emitting block from a first period, and which calculates fixed luminance data of the light-emitting block by using the duty ratio data and the fixed duty ratio data, the light source driving device configured to drive the light-emitting block by using a driving signal having a duty ratio corresponding to the duty ratio data; a compensation part which generates a compensated pixel data of an image block corresponding to the light-emitting block based on the fixed luminance data; and a panel driving part which drives the display panel using the compensated pixel data.

According to an exemplary embodiment, the light source driving device includes: a duty ratio determination part which determines the duty ratio data based on representative luminance data of the light-emitting block and pixel data; a fixed duty ratio extracting part which extracts the fixed duty ratio data by using the duty ratio data from the first period; a fixed luminance calculation part which calculates the fixed luminance data corresponding to a temperature of the light-emitting block based on the fixed duty ratio data; and a signal generation part which generates the driving signal having the duty ratio corresponding to the determined duty ratio data to drive the light-emitting block.

According to an exemplary embodiment, the fixed luminance calculation part includes a storage part which stores the luminance data corresponding to duty ratio data sampled from measured fixed duty ratio data, and the fixed luminance calculation part calculates the fixed luminance data by linear interpolation of the measured fixed duty ratio data.

According to an exemplary embodiment, the fixed luminance data is calculated by:

$$\Delta_{SAT} = PWM_{SAT} - (PWM_{SAT}\%10) \times 10$$

$$\Delta_{OUT} = PWM_{OUT} - (PWM_{OUT}\%10) \times 10$$

$$E = C + \frac{\Delta_{SAT}}{A - C}$$

$$F = D + \frac{\Delta_{OUT}}{F - E}$$

$$G = E + \frac{\Delta_{OUT}}{F - E}$$

where: $\Delta_{SAT}$ is a deviation of the fixed duty ratio data, $\Delta_{OUT}$ is a deviation of the duty ratio data, $PWM_{SAT}$ represents the fixed duty ratio data, $PWM_{SAT}$ % 10 represents a quotient of the fixed duty ratio data divided by 10, $PWM_{OUT}$ represents the duty ratio data, $PWM_{OUT}$ % 10 represents a quotient of the duty ratio data divided by 10, A and B are luminance data corresponding to a fixed duty ratio data greater than the fixed duty ratio data, C and D are luminance data corresponding to a fixed duty ratio data less than the fixed duty ratio data, E and F are luminance data corresponding to the fixed duty ratio data, and G is the fixed luminance data.

Thus, according to exemplary embodiments of the present invention, when duty ratio data of low luminance is maintained during a first period, a light source is using duty ratio data of a relatively higher luminance to effectively prevent a temperature of the light source from remaining at a low temperature. Further, luminance data of the light source is extracted from the duty ratio data during the first period, and pixel data is compensated using the extracted luminance data, and a displayed image thereby has substantially improved luminance accuracy.

BRIEF DESCRIPTION OF THE DRAWINGS

The above and other aspects, features and advantages of the present invention will become more readily apparent by describing in further detail exemplary embodiments thereof with reference to the accompanying drawings, in which.

DETAILED DESCRIPTION OF THE INVENTION

Figure 1:
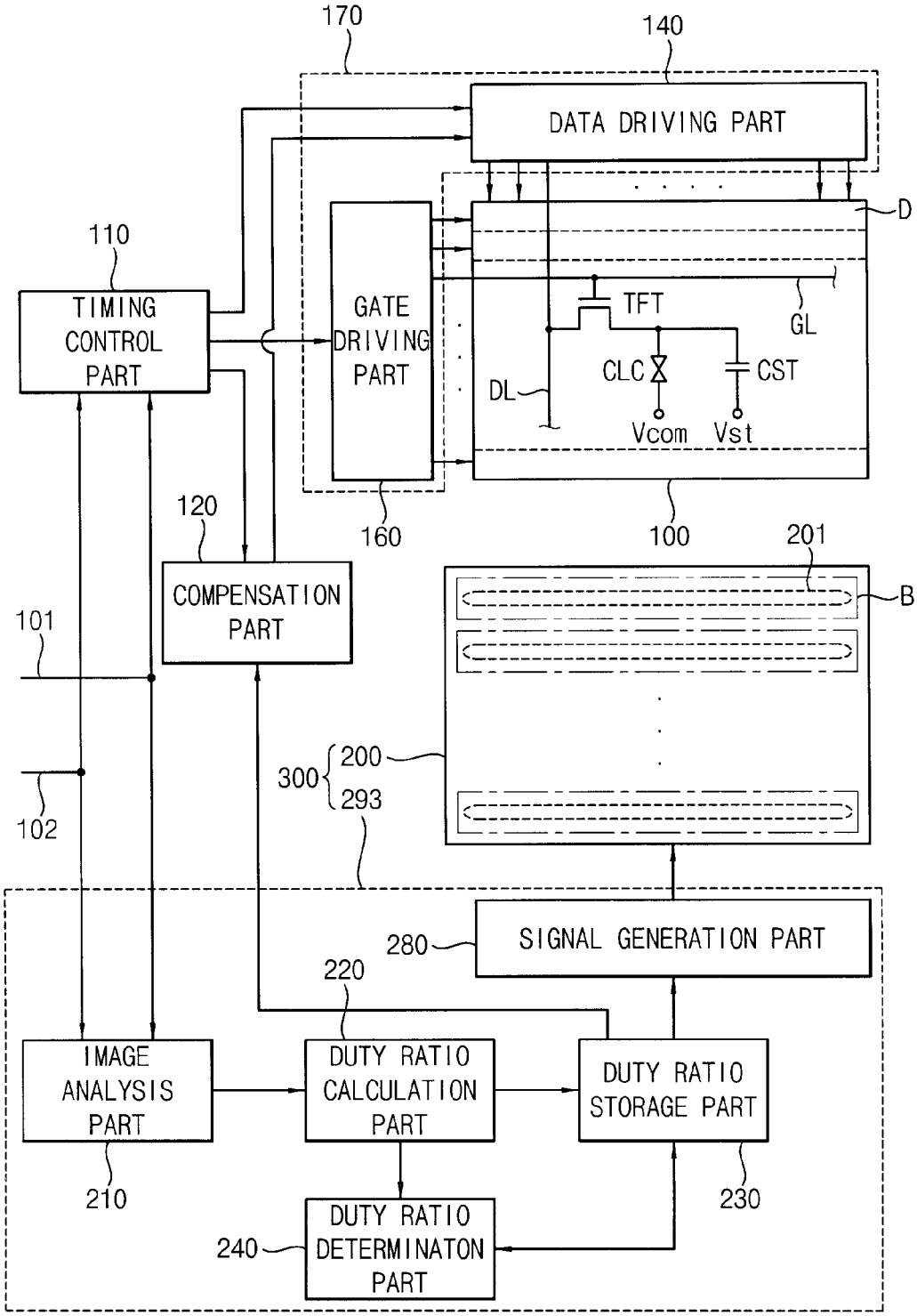
FIG. 1 is a block diagram of an exemplary embodiment of a display apparatus according to the present invention.

The invention will now be described more fully hereinafter with reference to the accompanying drawings, in which exemplary embodiments of the invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including," when used in this specification, specify the presence of stated features, regions, integers, steps, operations, elements and/or components, but do not preclude the presence or addition of one or more other features, regions, integers, steps, operations, elements, components and/or groups thereof.

Furthermore, relative terms, such as "lower" or "bottom" and "upper" or "top" may be used herein to describe one element's relationship to other elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on the "upper" side of the other elements. The exemplary term "lower" can, therefore, encompass both an orientation of "lower" and "upper," depending upon the particular orientation of the figure. Similarly, if the device in one of the figures were turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning which is consistent with their meaning in the context of the relevant art and the present disclosure, and will not be interpreted in an idealized or overly formal sense unless expressly so defined herein.

Exemplary embodiments of the present invention are described herein with reference to cross section illustrations which are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes which result, for example, from manufacturing. For example, a region illustrated or described as flat may, typically, have rough and/or nonlinear features. Moreover, sharp angles which are illustrated may be rounded. Thus, the regions illustrated in the figures are schematic in nature and their shapes are not intended to illustrate the precise shape of a region and are not intended to limit the scope of the present invention.

Hereinafter, exemplary embodiments will be described in further detail with reference to the accompanying drawings.

FIG. 1 is a block diagram of an exemplary embodiment of a display apparatus according to the present invention.

Referring to FIG. 1, a display apparatus according to an exemplary embodiment includes a display panel 100, a timing control part 110, a compensation part 120, a panel driving part 170 and a light source device 300.

The display panel 100 includes M data lines DL, N gate lines GL (where M and N are natural numbers) and a plurality of pixels. Each pixel of the plurality of pixels includes a switching element TFT, a liquid crystal capacitor CLC and a storage capacitor CST. The switching element TFT is connected to the gate line GL and the data line DL. The liquid crystal capacitor CLC is connected to the switching element TFT.

The timing control part 110 receives a control signal 101 and pixel data 102. The timing control part 110 generates a timing control signal for controlling an operation of the display panel 100 using the control signal 101. The timing control signal may include, for example, a clock signal, a horizontal starting signal and a vertical starting signal.

The compensation part 120 compensates the pixel data 102 by using duty ratio data, and outputs compensated pixel data to a data driving part 140. The duty ratio data will be described in further detail later.

The panel driving part 170 includes the data driving part 140 and a gate driving part 160. The data driving part 140 converts the compensated pixel data to an analog data voltage based on the timing control signal. The data driving part 140 outputs the analog data voltage to the data line DL of the display panel 100.

The gate driving part 160 generates a gate signal based on the timing control signal, and outputs the gate signal to the gate line GL of the display panel 100.

The light source device 300 includes a light source module 200 and a light source driving device 293.

The light source module 200 includes light sources 201. The light source module 200 is divided into light-emitting blocks B. Each light-emitting block B includes at least one light source 201. The light-emitting blocks B are individually operated. In an exemplary embodiment, a one-dimensional dimming mode or, alternatively, a two-dimensional dimming mode is utilized in the light source module 200, based on a configuration of the light sources 201. For example, when the light source 201 is a fluorescent lamp 201, the one-dimensional dimming mode, which locally dims the light source 201 in one direction, is applied to the light source module 200. Unless a lamp 201 operates for more than a predetermined time, allowing a temperature of the lamp 201 to become sufficiently high, a luminance is not be uniform even though the driving signal applied to the lamp 201 is substantially uniform. Moreover, when the lamp 201 operates at a relatively low luminance for a relatively long time, it is difficult to obtain a desirable luminance because the lamp 201 cools down, and thus, a density of mercury gas in the lamp 201 is adversely affected. In addition, in the one-dimensional dimming mode, the lamp 201 is not always turned on, and temperatures of the lamps 201 of each light-emitting block B therefore become different from each other. Accordingly, the lamps 201 have different luminances, according to the temperatures of each of the lamps 201 in each light-emitting block B, even though the same driving signal is applied to each light-emitting block B.

Thus, the light source driving device 293 according to an exemplary embodiment operates, e.g., drives, the light source module 200 to effectively prevent the temperature of the light source 201 from being fixed at a low temperature when the light source 201 operates at low luminance for a long time.

The light source driving device 293 includes an image analysis part 210, a duty ratio calculation part 220, a duty ratio storage part 230, a duty ratio determination part 240 and a signal generation part 280.

The image analysis part 210 divides a frame image into a plurality of image blocks D, corresponding to the light-emitting blocks B (best shown in FIG. 1), by using the control signal 101 and the pixel data 102. Specifically, the image analysis part 210 extracts representative luminance data for the light-emitting blocks B by using the pixel data 102 corresponding to each image block D. Examples of methods for extracting the representative luminance data of the light-emitting block B may include an average-value extracting method and a maximum-value extracting method, but alternative exemplary embodiments are not limited thereto. More specifically, in the average-value extracting method, an average value of the pixel data 102 of an image block D is extracted as the representative luminance data. On the other hand, in the maximum-value extracting method, a maximum value of the pixel data 102 of an image block D is extracted as the representative luminance data.

The duty ratio calculation part 220 calculates duty ratio data of a driving signal for operating, e.g., driving, the light source 201 by using the representative luminance data of the light-emitting block B provided from the image analysis part 210. In an exemplary embodiment, for example, the driving signal may be a pulse width modulation ("PWM") signal, and a duty ratio data may be in a range of about 10% to about 50%, but alternative exemplary embodiments are not limited thereto. In an alternative exemplary embodiment, for example, the range of the duty ratio data may be modified according to a design of the light source device 300 and/or operational characteristics of the light source 201, for example.

The duty ratio storage part 230 stores the duty ratio data corresponding to the light-emitting blocks B in each frame. In addition, the duty ratio storage part 230 may store the duty ratio data determined by the duty ratio determination part 240.

In operation, the duty ratio determination part 240 determines whether to use the duty ratio data as a duty ratio of the driving signal for operating the light-emitting blocks B.

More specifically, the duty ratio determination part 240 checks the duty ratio data stored in the duty ratio storage part 230, and determines whether the duty ratio data is less than a predetermined value during a first period T1. When the duty ratio data of the light-emitting block B is less than the predetermined value during the first period T1, the duty ratio determination part 240 outputs determined duty ratio data at a relatively high duty ratio (with respect to a duty ratio of the duty ratio data of the light-emitting block B during the first period T1) to the light-emitting block B during a second period T2 subsequent to the first period T1. Accordingly, the light-emitting block B generates light having a relatively high luminance even when a luminance of the pixel data 102 of the image block D during the second period T2 is low. In an exemplary embodiment, for example, when the range of the duty ratio data of the driving signal for operating the light source 201 is from about 10% to about 50%, the predetermined value may be 20%, and the high duty ratio data may be in a range of about 30% to about 50%.

Alternatively, when the duty ratio data of the light-emitting block B is not continuously lower than the predetermined value during the first period T1, e.g., is greater than or equal to the predetermined value during the first period T1, the duty ratio determination part 240 outputs the determined duty ratio data having a duty ratio calculated in the duty ratio calculation part 220 as the driving signal. Thereafter, e.g., for a next frame, the duty ratio data stored in the duty ratio storage part 230 is updated with the determined duty ratio data.

The duty ratio determination part 240 provides the signal generation part 280 and the compensation part 120 with the determined duty ratio data. The compensation part 120 compensates the pixel data 102 of the image block D based on the determined duty ratio data. For example, a gray scale of the pixel data 102 decreases when the duty ratio of the determined duty ratio data is relatively low (e.g., when the determined duty ratio data is less than the predetermined value), and the gray scale of the pixel data 102 increases when the determined duty ratio data has a relatively high duty ratio (e.g., when the determined duty ratio data is greater than or equal to the predetermined value). Accordingly, a contrast ratio of a displayed image is substantially improved in a display apparatus according to an exemplary embodiment. Further, the compensation part 120 compensates the pixel data 102 to reduce a gray scale of the pixel data 102 of the image block D corresponding to a light-emitting block B having the determined duty ratio data with the duty ratio data which has the relatively high duty ratio (with respect to the duty ratio of the duty ration data of the light-emitting block B of the image block D), and glare is thereby substantially reduced and/or effectively prevented.

The signal generation part 280 generates the driving signal using the duty ratio data of the light-emitting block B provided from the duty ratio determination part 240. Further, the signal generation part 280 provides the light-emitting block B with the driving signal to operate, e.g., to drive, the light-emitting block B.

Figure 2:
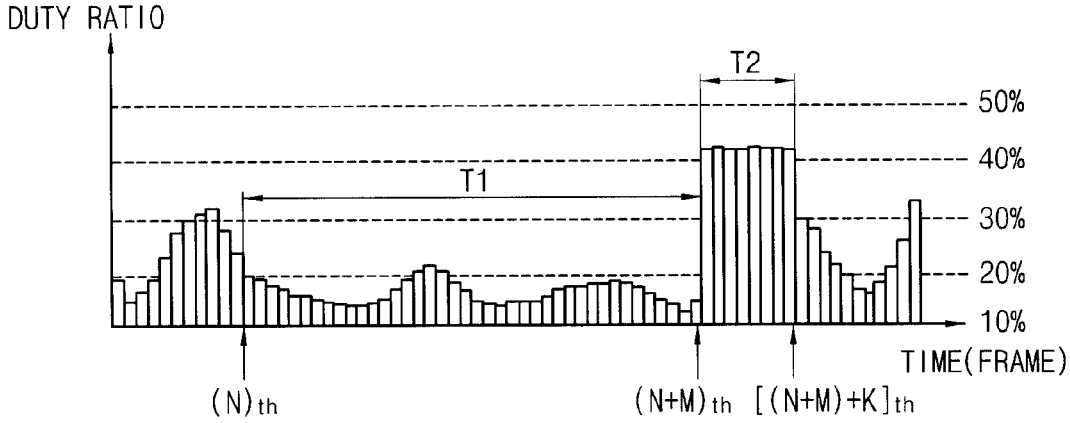
FIG. 2 is a graph of duty ratio versus time illustrating a variation of an exemplary embodiment of a light-emitting block of a light source driving device of the display apparatus shown in FIG. 1.

FIG. 2 is a graph of duty ratio versus time illustrating a variation of a light-emitting block of a light source driving device of the display apparatus shown in FIG. 1.

Referring to FIGS. 1 and 2, a method of operating a first light-emitting block B of the plurality of the light-emitting blocks B will now be described in further detail. The duty ratio storage part 230 stores a first duty ratio data corresponding to the first light-emitting block B during a first period T1. The duty ratio determination part 240 checks the duty ratio data stored in the duty ratio storage part 230, and determines whether the first duty ratio data is less than a predetermined value (for example, 25%) from an (N)-th frame to an (N+M)th frame (e.g., during the first period T1). More particularly, the duty ratio determination part 240 determines whether the lamp 201 of the first light-emitting block B operates at a relatively low luminance during the first period T1.

When the duty ratio determination part 240 determines that the lamp 201 of the first light-emitting block B operates at the relatively low luminance during the first period T1, the duty ratio determination part 240 forcefully outputs determined duty ratio data having a high duty ratio (e.g., a duty ratio of about 42%, as shown in FIG. 2) as the determined duty ratio data of the first light-emitting block B from the (N+M)-th frame to and [(N+M)+K]-th frame (e.g., during a second period T2, subsequent to the first period T1). In an exemplary embodiment, N, M and K are natural numbers. Accordingly, the lamp 201 of the first light-emitting block B operates at a relatively high luminance during the second period T2, and thus the lamp 201 is effectively prevented from cooling down by operating at a relatively low luminance for a long time, e.g., for an extended period of time. Next, the duty ratio storage part 230 stores second duty ratio data, corresponding to the first light-emitting block B from the [(N+M)+K]-th frame, to a subsequent frame, e.g., to a frame which is the first period added to the [(N+M)+K]-th frame.

Figure 3A:
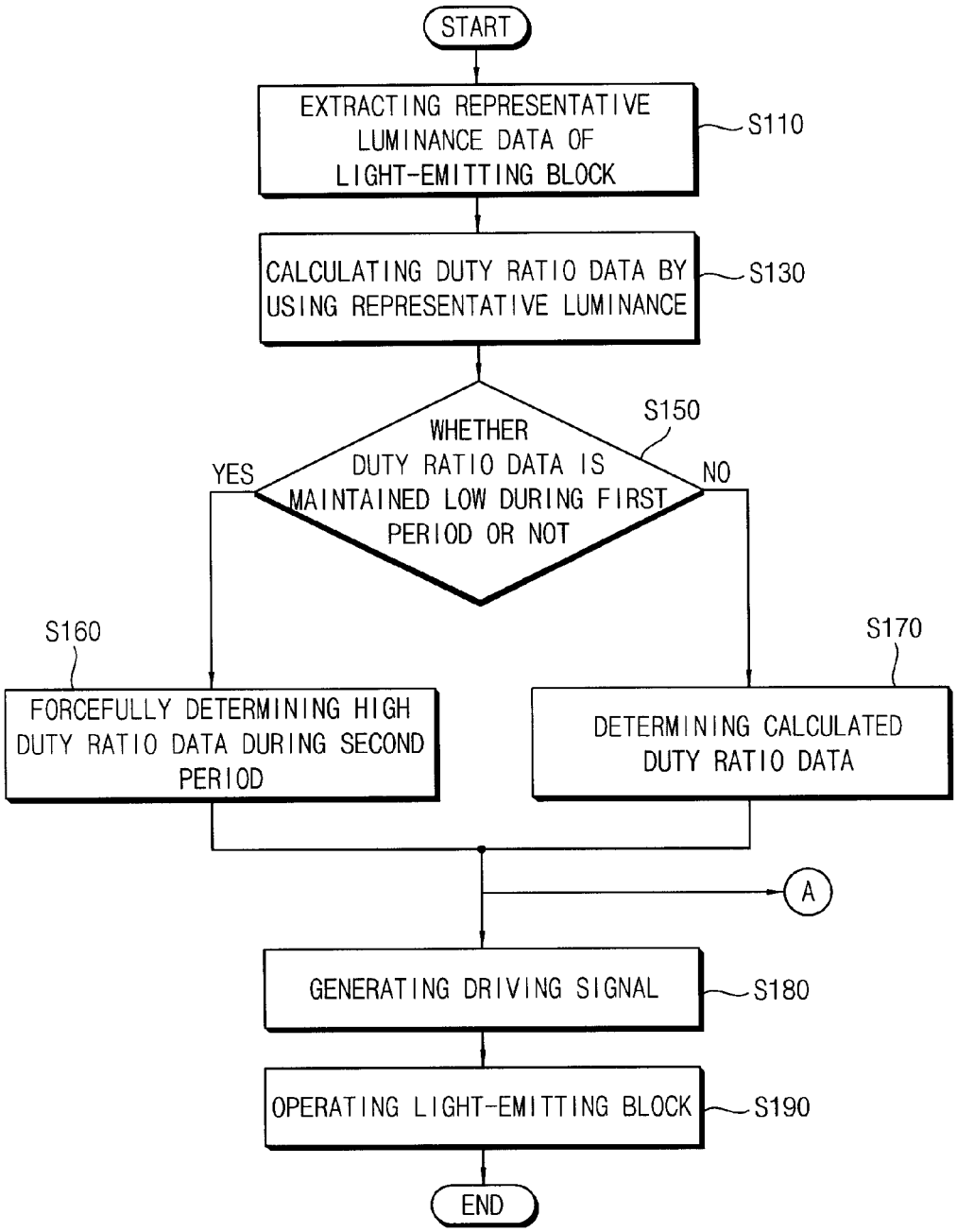
FIGS. 3A and 3B are flowcharts illustrating an exemplary embodiment of a method of operating the display apparatus shown in FIG. 1.
Figure 3B:
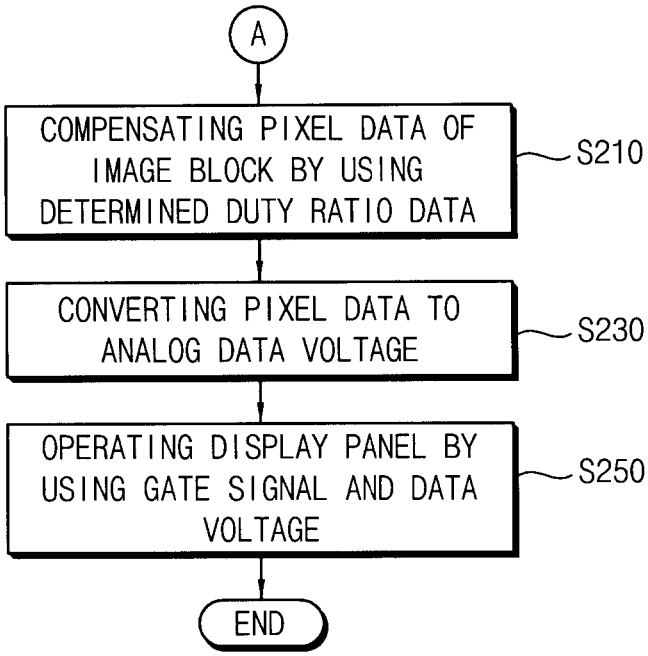

FIGS. 3A and 3B are flowcharts for describing an exemplary embodiment of a method of operating, e.g., driving, the display apparatus shown in FIG. 1.

Referring to FIGS. 1, 3A and 3B, the method of operating the display apparatus includes a light source operating method for operating the light source module 200 (FIG. 3A) and a panel operating method for operating the display panel 100 (FIG. 3B). The light source operating method shown in FIGS. 1 and 3A will now be described in further detail.

The pixel data 102 is divided into a plurality of the image blocks D corresponding to the light-emitting blocks B. The image analysis part 210 extracts representative luminance data of each light-emitting block B by using the pixel data 102 of each image block D (step S110).

The duty ratio calculation part 220 calculates duty ratio data for controlling a luminance of the light-emitting block B based on the representative luminance data (step S130).

The duty ratio determination part 240 determines whether the duty ratio data stored in the duty ratio storage part 230 is less than a predetermined value during a first period T1 (step S150). When the duty ratio data of the light-emitting block B is maintained at a low duty ratio, e.g., is less than the predetermined value, during the first period T1, the duty ratio determination part 240 forcefully determines, e.g., outputs, determined duty ratio data having a relatively high duty ratio as the determined duty ratio of the light-emitting block B during a second period T2 subsequent to the first period T1 (step S160).

When the duty ratio data of the light-emitting block B is not continuously maintained at the low duty ratio data during the first period T1, e.g., is greater than or equal to the predetermined value, the duty ratio determination part 240 determines, e.g., outputs, the determined duty ratio data to have the duty ration calculated in the duty ratio calculation part 220 as the determined duty ratio data of the light-emitting block B (step S170).

Thereafter, the determined duty ratio data corresponding to the light-emitting block B determined in the duty ratio determination part 240 is provided to the signal generation part 280. In addition, the duty ratio storage part 230 stores the determined duty ratio data.

The signal generation part 280 generates a driving signal having a duty ratio corresponding to the determined duty ratio data (step S180). The light-emitting block B is driven by the driving signal (step S190). Thus, the light-emitting block B, driven by the forcefully determined duty ration data having the relatively high duty ratio data operates at a high luminance, and, on the other hand, the light-emitting block B driven by the calculated duty ration data operates at a luminance of the original image, e.g., at a relatively lower luminance.

The panel operating method will now be described in further detail with reference to FIGS. 1 and 3B.

Referring to FIGS. 1 and 3B, the determined duty ratio data determined in the duty ratio determination part 240 is provided to the compensation part 120.

The compensation part 120 compensates the pixel data 102 of the image block D based on the determined duty ratio data (step S210). In an exemplary embodiment, for example, a gray scale of the pixel data 102 decreases when the determined duty ratio data is the relatively low duty ratio data, and the gray scale of the pixel data 102 increases when the determined duty ratio data is the relatively high duty ratio data. As a result, a contrast ratio of a displayed image is substantially improved. Further, the compensation part 120 compensates the pixel data 102 to reduce a gray scale of the pixel data 102 of the image block D corresponding to the light-emitting block B having the determined duty ratio data which is forcefully determined to have the relatively higher duty ratio, and glare is thereby substantially reduced and/or effectively prevented.

The data driving part 140 converts the pixel data 102 to an analog data voltage (step S230). The data driving part 140 outputs the analog data voltage to the data line DL of the display panel 100.

The gate driving part 160 outputs a gate signal to the gate line GL of the display panel 100 synchronized with the timing of the data voltage. Accordingly the display panel 100 displays a desired image (step S250).

Figure 4:
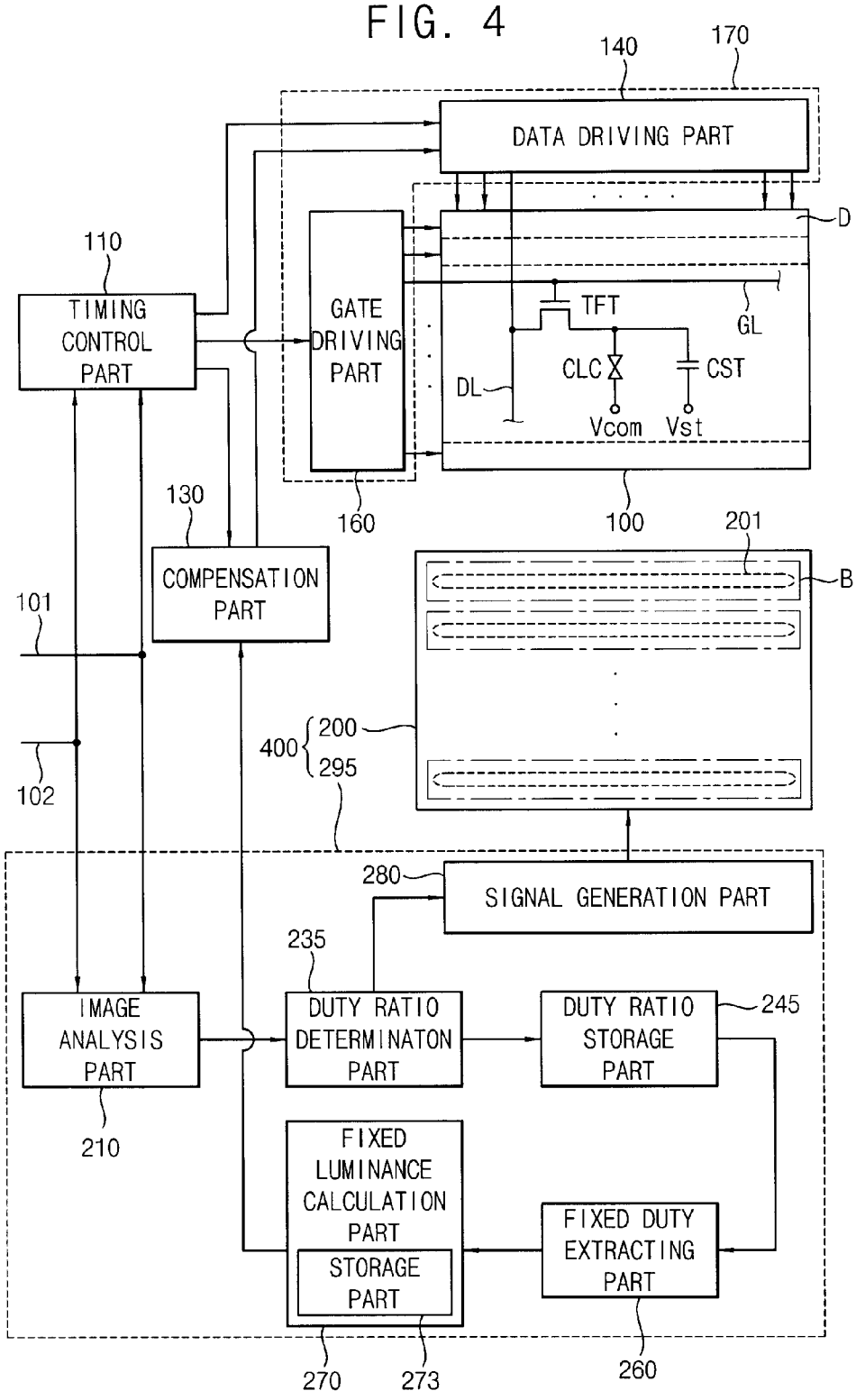
FIG. 4 is a block diagram of an alternative exemplary embodiment of a display apparatus according to the present invention.

FIG. 4 is a block diagram of an alternative exemplary embodiment of a display apparatus according to the present invention.

Referring to FIG. 4, display apparatus according to an exemplary embodiment includes a display panel 100, a timing control part 110, a compensation part 130, a panel driving part 170 and a light source device 400.

The display panel 100 includes M data lines, DL N gate lines DL (where M and N are natural numbers) and a plurality of pixels. Each pixel of the plurality of pixels includes a switching element TFT, a liquid crystal capacitor CLC and a storage capacitor CST. The switching element TFT is connected to the gate line GL and the data line DL. The liquid crystal capacitor CLC is connected to the switching element TFT.

The timing control part 110 receives a control signal 101 and pixel data 102. The timing control part 110 generates a timing control signal for controlling an operation of the display panel 100 by using the control signal 101. The timing control signal may include a clock signal, a horizontal starting signal and a vertical starting signal, for example, but alternative exemplary embodiments are not limited thereto.

The compensation part 130 compensates the pixel data 102 by using fixed duty ratio data corresponding to a luminance of the light source 201, and outputs compensated pixel data to the data driving part 140. The fixed duty ratio data will be described in further detail later.

The panel driving part 170 includes the data driving part 140 and a gate driving part 160. The data driving part 140 converts the pixel data 102 to an analog data voltage based on the timing control signal. The data driving part 140 outputs the analog data voltage to the data line DL of the display panel 100.

The gate driving part 160 generates a gate signal based on the timing control signal, and outputs the gate signal to the gate line GL of the display panel 100.

The light source device 400 includes a light source module 200 and a light source driving device 295.

The light source module 200 includes a plurality of light sources 201. The light source module 200 is divided into a plurality of light-emitting blocks B. Each light-emitting block B of the plurality of light-emitting blocks B includes at least one light source 201. The light-emitting blocks B are individually operated, e.g., driven. More specifically, a one-dimensional dimming mode or, alternatively, a two-dimensional dimming mode may be used to drive the light source module 200, based on a configuration of the light source 201. For example, when the light source 201 is a fluorescent lamp 201, the one-dimensional dimming mode which locally dims the light source 201 in one direction is used in the light source module 200. Unless the lamp 201 operates for longer than a predetermined amount of time, causing a temperature of the lamp 201 to become relatively high, a luminance is not uniform even though a same driving signal is applied to the lamp 201 over time. Further, when the lamp 201 operates at a relatively low luminance for an extended period of time, a desirable luminance cannot be sustained, because the lamp 201 cools down and a density of a mercury gas therein is adversely affected. In the one-dimensional dimming mode, the lamp 201 is not always turned on, and temperatures of the lamps 201 of each light-emitting block B are therefore different. Accordingly, the lamps 201 have different luminances according to the different temperatures of each of the lamps 201 of each light-emitting block B, even though a same driving signal is applied to each light-emitting block B.

The light source driving device 295 extracts fixed luminance data, fixed at the light source 201 to display an image having a luminance having a substantially improved accuracy on the display panel 100 according to an exemplary embodiment.

The light source driving device 295 according to an exemplary embodiment includes an image analysis part 210, a duty ratio determination part 235, a fixed duty ratio extracting part 260 and a fixed luminance calculation part 270.

The image analysis part 210 divides frames of the pixel data 102 into a plurality of image blocks D corresponding to the light-emitting blocks B by using the control signal 101 and the pixel data 102. The image analysis part 210 extracts representative luminance data of the light-emitting blocks B by using the pixel data 102 of each image block D of the plurality of image blocks D. Examples of methods for extracting the representative luminance data of the light-emitting block B include an average-value extracting method and maximum-value extracting method, but alternative exemplary embodiments are not limited thereto. In the average-value extracting method, for example, an average value of the pixel data 102 of the image block D is extracted as the representative luminance data. In the maximum-value extracting method, on the other hand, a maximum value of the pixel data 102 of the image block D is extracted as the representative luminance data.

The duty ratio determination part 235 determines duty ratio data of a driving signal for operating, e.g., for driving, the light source 201 by using the representative luminance data of the light-emitting block B provided from the image analysis part 210. In an exemplary embodiment, for example, the driving signal may be a PWM signal, and a duty ratio data thereof may be in a range of about 10% to about 50%. The range of the duty ratio data may, however, be modified in alternative exemplary embodiments, according to a design of the light source device 400 and/or operational characteristics of the light source 201.

The duty ratio storage part 245 stores the duty ratio data corresponding to the light-emitting blocks B in each frame. In an exemplary embodiment, when a same driving signal (e.g., a PWM signal having a same duty ratio) is continuously provided to the lamp 201 for about twenty minutes, for example, the luminance of the lamp 201 is fixed at a luminance corresponding to the duty ratio of the PWM signal. Therefore, the duty ratio data of the PWM signal for the past twenty minutes is necessary to know the duty ratio of the PWM signal corresponding to the luminance at which the lamp 201 is fixed. However, when twenty minutes of duty ratio data is stored in each frame, an amount of the duty ratio data substantially increases. Moreover, in a typical image, duty ratio data of successive frames substantially the same due to continuity of the image. Further, various algorithms for minimizing differences between adjacent light-emitting blocks B and/or adjacent frames may be employed and, thus, the duty ratio data of the adjacent frames is often substantially the same in an exemplary embodiment.

Therefore, the duty ratio storage part 245 according to an exemplary embodiment may store the duty ratio data for a period of ten minutes, for example, but alternative exemplary embodiments are not limited thereto.

Additionally, in an exemplary embodiment, the duty ratio data may be in a predetermined range based on the operating characteristics of the lamp 201. For example, a minimum duty ratio may be determined such that the lamp 201 operates for a predetermined time, while a maximum duty ratio may be determined such that operation of the lamp 201 satisfies a maximum luminance according to a design of the lamp 201. Therefore, the duty ratio data according to an exemplary embodiment may be divided into several driving sections. For example, when the range of the duty ratio data is from about 10% to about 50%, the duty ratio data may be divided into four driving sections. Accordingly, when the duty ratio data is 10-bit data, the duty ratio storage part 245 may store the most significant 3 bits of data.

More generally, the duty ratio storage part 245 according to an exemplary embodiment may periodically store a most significant J-bit data of the duty ratio data every I frames during a predetermined period (where I and J are natural numbers). In an exemplary embodiment, a first period, e.g., a predetermined period, is a time required to fix the light source 201 at a predetermined luminance.

The fixed duty ratio extracting part 260 extracts fixed duty ratio data corresponding to the fixed luminance of the light source 201 during the predetermined period, e.g., the first period, using the duty ratio data stored in the duty ratio storage part 245.

In an exemplary embodiment, the fixed luminance calculation part 270 includes a storage part 273. In addition, the storage part 273 stores luminance data corresponding to duty ratio data sampled from measured fixed duty ratio data. The fixed luminance calculation part 270 calculates the fixed luminance data by using the fixed duty ratio data in the fixed duty ratio extracting part 260 and the actual duty ratio data determined by the duty ratio determination part 235. The fixed luminance data may be compensated representative luminance data extracted from the image analysis part 210 and compensated according to the duty ratio of the light source 201.

The fixed luminance calculation part 270 provides the compensation part 130 with the fixed luminance data. The compensation part 130 compensates the pixel data 102 of the image block D by using the fixed luminance data. Accordingly, the display panel 100 displays an image using the pixel data 102 compensated according to the luminance of the light-emitting block B, so that the display apparatus displays an image having a luminance which is substantially the same as a luminance of an original image.

The signal generation part 280 generates a driving signal using the duty ratio data of the light-emitting block B provided from the duty ratio determination part 235. The signal generation part 280 provides the light-emitting block B with the driving signal to drive the light-emitting block B.

Figure 5:
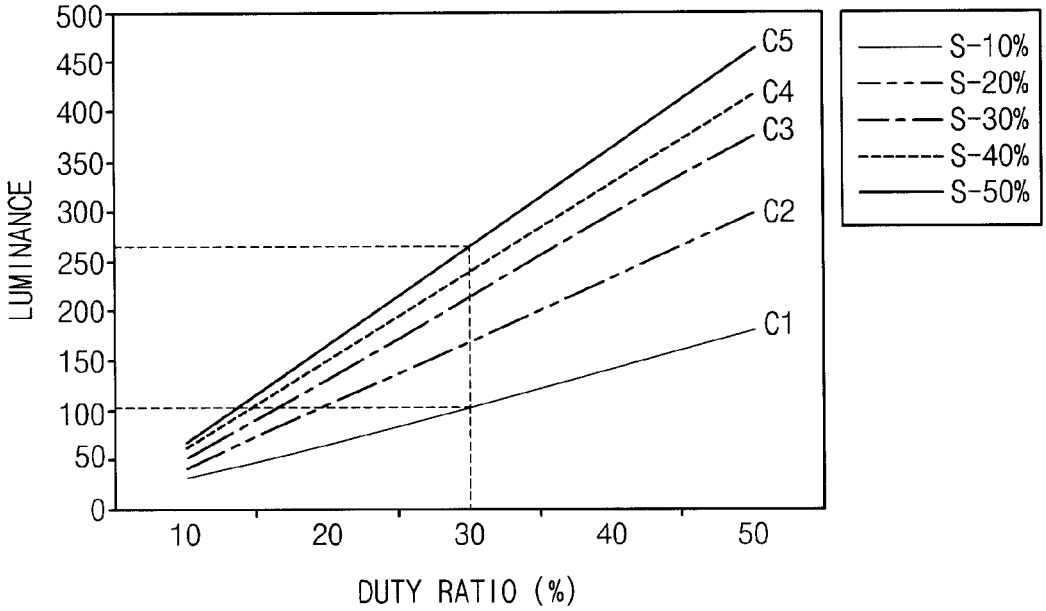
FIG. 5 is a graph of luminance versus duty ratio illustrating a fixed duty ratio of the display apparatus shown in FIG. 4.

FIG. 5 is a graph of luminance versus duty ratio data illustrating a fixed duty ratio of the display apparatus shown in FIG. 4.

Referring to FIGS. 4 and 5, a first graph C1 illustrates luminance data and duty ratio data when the light source 201 is fixed at a duty ratio of about 10%. A second graph C2 illustrates luminance data and duty ratio data when the light source 201 is fixed at a duty ratio of about 20%. A third graph C3 illustrates luminance data and duty ratio data when the light source 201 is fixed at a duty ratio of about 30%. A fourth graph C4 illustrates luminance data and duty ratio data when the light source 201 is fixed at a duty ratio of about 40%. A fifth graph C5 illustrates luminance data and duty ratio data when the light source 201 is fixed at a duty ratio of about 50%.

Referring to the first through fifth graphs C1 through C5, respectively, it can be seen that luminance varies linearly with the duty ratio data.

Comparing the first graph C1 which corresponds to the lowest duty ratio of about 10% with the fifth graph C5 which corresponds to the highest duty ratio of about 50%, luminance of the duty ratio data of about 30% according to the fifth graph C5 is about 260, while luminance of the duty ratio data of about 30% according to the first graph C1 is about 100. Thus, the luminance of the same duty ratio data is higher than the fixed duty ratio data.

The storage part 273 of the fixed luminance calculation part 270 stores luminance data and duty ratio data sampled from a luminance variation according to the fixed duty ratio. The fixed luminance calculation part 270 calculates the fixed luminance data of the light source 201 using the sampled luminance data and the duty ratio data stored in the storage part 273 and measured duty ratio data. In an exemplary embodiment, the fixed luminance calculation part 270 may use a linear interpolation method to calculate the fixed luminance data of the light source 201.

Figure 6:
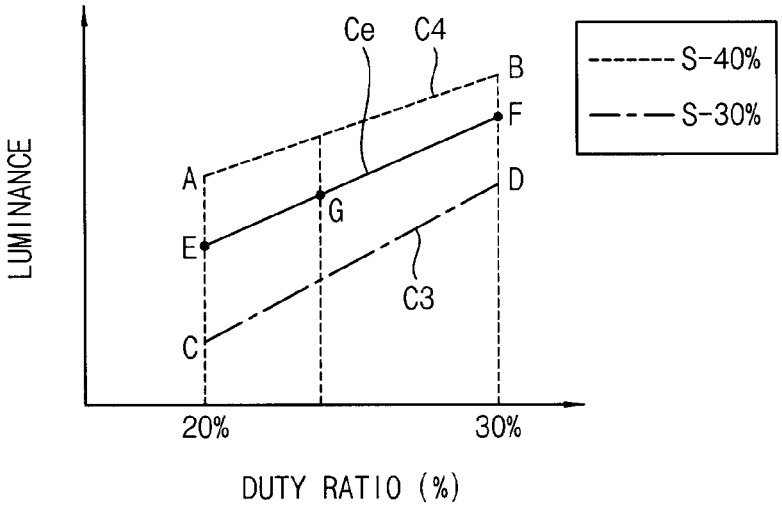
FIG. 6 is a graph of luminance versus duty ratio for explaining an exemplary embodiment of a linear interpolation method used in a fixed luminance calculation part of the display apparatus shown in FIG. 4.

FIG. 6 is a graph of luminance versus duty ration for explaining an exemplary embodiment of a linear interpolation method used in a fixed luminance calculation part of the display apparatus shown in FIG. 4.

Referring to FIGS. 4 and 6, it will be assumed only for purposes of description thereof that a fixed duty ratio data $PWM_{SAT}$ extracted in the fixed duty ratio extracting part 260 is about 36% and an actual duty ratio data $PWM_{OUT}$ determined in the duty ratio determination part 235 is about 23%.

The fixed luminance calculation part 270 determines a deviation of the fixed duty ratio ΔSAT and a deviation of the actual fixed duty ratio ΔOUT according to Equation 1.

$$\Delta_{SAT}=PWM_{SAT}-(PWM_{SAT}\%\ 10)\times 10 \qquad \text{[Equation 1]}$$

$$\Delta_{OUT}=PWM_{OUT}-(PWM_{OUT}\%\ 10)\times 10$$

In Equation 1, $PWM_{SAT}$ % 10 represents a quotient of the fixed duty ratio data $PWM_{SAT}$ divided by 10, and $PWM_{OUT}$ % 10 represents a quotient of the actual duty ratio data $PWM_{OUT}$ divided by 10. For example, when $PWM_{SAT}$ is 36, ($PWM_{SAT}$ % 10)×10 is (3)×10, which is 30. Thus, the deviation of the fixed duty ratio ΔSAT is 6 (i.e., 36−30). When $PWM_{OUT}$ is 23, ($PWM_{OUT}$ % 10)×10 is (2)×10, which is 20. Thus, the deviation of the actual fixed duty ratio ΔOUT is 3 (i.e., 23-20).

The fixed luminance calculation part 270 calculates a calculated graph Ce showing luminance data and duty ratio data when the light source 201 is fixed at a duty ratio of about 36%, by using the linear interpolation method for first and second luminance data A and B, respectively, of the fourth graph C4 (e.g., the graph showing the luminance data to the duty ratio data when the light source 201 is fixed at a duty ratio of about 40%) and third and fourth luminance data C and D, respectively, of the third graph C3 (e.g., the graph showing the luminance data to the duty ratio data when the light source 201 is fixed at a duty ratio of about 30%). Fifth and sixth luminance data E and F, respectively, of the calculated graph Ce are calculated by Equation 2.

$$E = C + \frac{\Delta_{SAT}}{A - C} \qquad \text{[Equation 2]}$$

$$F = D + \frac{\Delta_{OUT}}{F - E}$$

By using the fifth and sixth luminance data E and F, respectively, calculated by Equation 2, luminance data G corresponding to the actual duty ratio data of 23% is calculated by the linear interpolation method according to an exemplary embodiment. The calculated luminance data G is the fixed luminance data, which is calculated by Equation 3.

$$G = E + \frac{\Delta_{OUT}}{F - E} \qquad \text{[Equation 3]}$$

Figure 7A:
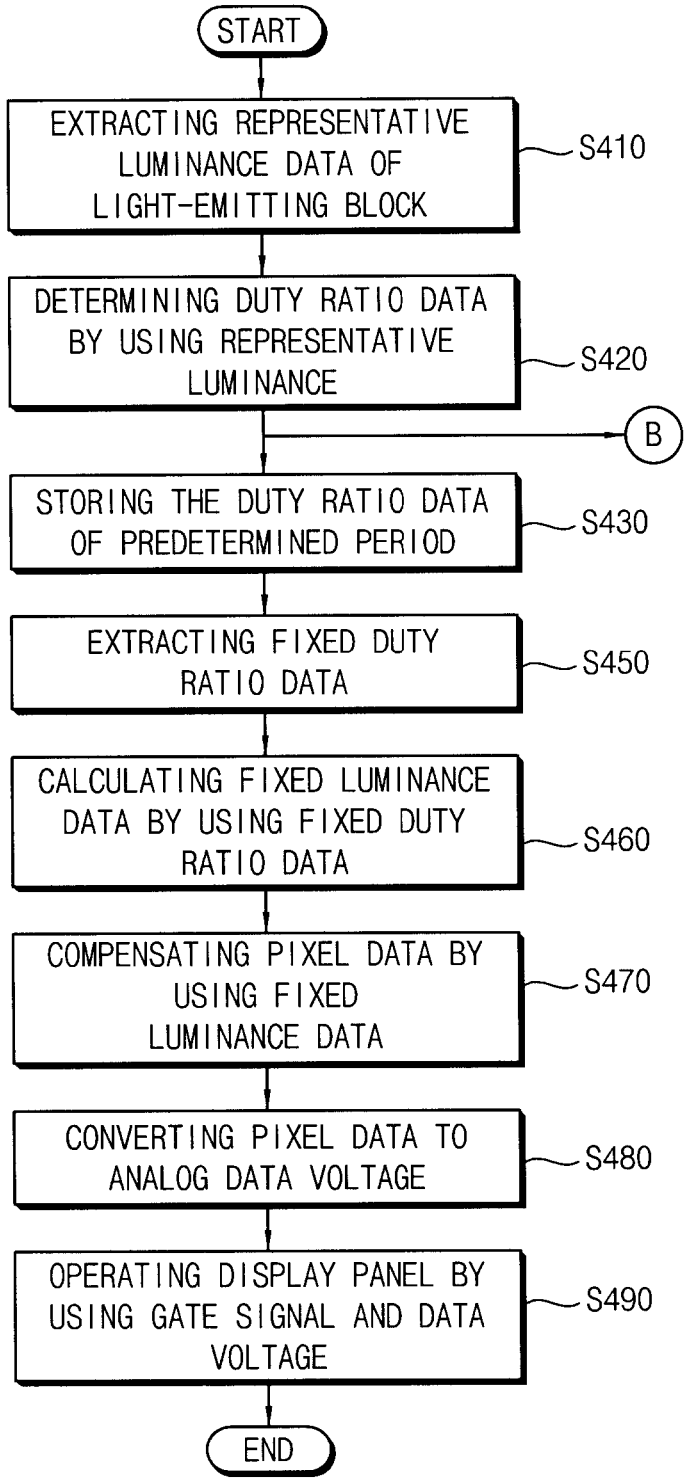
FIGS. 7A and 7B are flowcharts for describing an exemplary embodiment of a method of operating the display apparatus shown in FIG. 4.
Figure 7B:
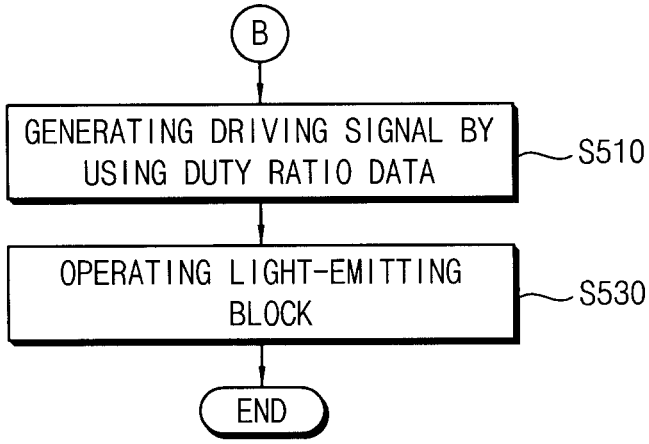

FIGS. 7A and 7B are flowcharts for describing an exemplary embodiment of a method of operating the display apparatus shown in FIG. 4.

Referring to FIGS. 4 and 7A, the method of operating the display apparatus includes a light source operating method (FIG. 7A) for operating the light source module 200 and a panel operating method (FIG. 7B) for operating the display panel 100. Hereinafter, the light source operating method, shown in FIGS. 4 and 7A will be described in further detail.

The pixel data 102 is divided into a plurality of image blocks D corresponding to the light-emitting blocks B. The image analysis part 210 extracts representative luminance data of each light-emitting block B by using the pixel data 102 of each image block D of the plurality of image blocks D (step S410).

The duty ratio determination part 245 determines duty ratio data that controls the luminance of the light-emitting block B by using the representative luminance data (step S420).

The duty ratio data is stored in the duty ratio storage part 245 during a predetermined period, e.g., the first period T1 (step S430). The fixed duty ratio extracting part 260 extracts fixed duty ratio data corresponding to a luminance of the light source 201 fixed during the predetermined period using the duty ratio data stored in the duty ratio storage part 245 (step S450).

The fixed luminance calculation part 270 calculates the fixed luminance data using the fixed duty ratio data extracted in the fixed duty ratio extracting part 260 and the actual duty ratio data determined in the duty ratio determination part 235 (step S460).

The compensation part 130 compensates the pixel data 102 of the image block D using the determined duty ratio data (step S470). In an exemplary embodiment, for example, the gray scale of the pixel data 102 decreases when the determined duty ratio data has a relatively low duty ratio, and the gray scale of the pixel data 102 increases when the determined duty ratio data has a relatively high duty ratio. Accordingly, a contrast ratio of a displayed image is substantially improved.

The data driving part 140 converts the pixel data 102 provided from the compensation part 130 to an analog data voltage (step S480). The data driving part 140 outputs the analog data voltage to the data line DL of the display panel 100.

The gate driving part 160 outputs a gate signal to the gate line GL of the display panel 100 synchronized with a timing of when the data voltage is outputted. Accordingly, the display panel 100 displays an image (step S490).

As a result, the display panel 100 according to an exemplary embodiment displays an image using the pixel data 102, compensated according to the luminance of the light-emitting block B, so that the display apparatus displays the image having substantially a same luminance as an original image.

Referring to FIGS. 4 and 7B, the duty ratio data of the light-emitting block B determined from the duty ratio determination part 235 is provided to the signal generation part 280. The signal generation part 280 generates a driving signal having a duty ratio corresponding to the duty ratio data (step S510). The light-emitting block B is driven by the driving signal (step S530).

According to exemplary embodiments of the present invention, when a low luminance duty ratio data is maintained during a first period, a light source is operated by using a relatively high luminance duty ratio data, and the light source is thereby effectively prevented from being fixed at a relatively low temperature. Further, fixed luminance data of the light source is calculated using duty ratio data during the first period, and pixel data is compensated using the calculated luminance data, and the display apparatus thereby display an image having a substantially improved luminance accuracy.

The present invention should not be construed as being limited to the exemplary embodiments set forth herein. Rather, these exemplary embodiments are provided so that this disclosure will be thorough and complete and will fully convey the concept of the present invention to those skilled in the art.

While the present invention has been particularly shown and described with reference to exemplary embodiments thereof, it will be understood by those of ordinary skill in the art that various changes in form and details may be made therein without departing from the spirit or scope of the present invention as defined by the following claims.

What is claimed is:

1. A light source device comprising:

a light source module divided into a plurality of light-emitting blocks, which are individually operated;

an image analysis part which extracts representative luminance data of a light-emitting block of the plurality of light-emitting blocks based on pixel data corresponding to the light-emitting block;

a duty ratio calculation part which calculates duty ratio data of the light-emitting block based on the representative luminance data;

a duty ratio storage part which stores duty ratio data;

a duty ratio determination part which generates determined duty ratio data of the light-emitting block based on the duty ratio data calculated from the duty ratio calculation part and the duty ratio data stored in the duty ratio storage part during a first period corresponding to a plurality of frames; and a signal generation part which generates a driving signal having a duty ratio corresponding to the determined duty ratio data to drive the light-emitting block, wherein the determined duty ratio data is a predetermined high duty ratio applied to the light-emitting block during a second period corresponding to a plurality of frames, when the duty ratio data of the light-emitting block is less than a predetermined value during the first period.

2. The light source device of claim 1, wherein the determined duty ratio data is the duty ratio data of the light-emitting block when the duty ratio data of the light-emitting block is greater than or equal to the predetermined value during the first period.

3. The light source device of claim 1, wherein the duty ratio corresponding to the determined duty ratio data to drive the light-emitting block at a moderate temperature is in a range of about 10% to about 50%.

4. A display apparatus comprising:

a display panel which displays an image;

a light source module divided into a plurality of light-emitting blocks, which are individually operated, the light source module providing the display panel with light;

a light source driving device which calculates duty ratio data of the light-emitting block based on pixel data, the light source driving device configured to generate determined duty ratio data based on the duty ratio data calculated from a duty ratio calculation part and the duty ratio data stored in a duty ratio storage part during a first period corresponding to a plurality of frames, and configured to drive the light-emitting block by supplying a driving signal having a duty ratio corresponding to the determined duty ratio data;

a compensation part which receives the driving signal from the light source driving device and generates compensated pixel data by compensating the pixel data of an image block corresponding to the light-emitting block based on the driving signal having the duty ratio corresponding to the determined duty ratio data; and a panel driving part which drives the display panel based on the compensated pixel data, wherein the determined duty ratio data is a predetermined high duty ratio applied to the light-emitting block during second period corresponding to a plurality of frames, when the duty ratio data of the light-emitting block is less than a predetermined value during the first period.

5. The display apparatus of claim 4, wherein the light source driving device comprises:

an image analysis part which extracts representative luminance data of the light-emitting block based on the pixel data;

a duty ratio determination part which generates the determined duty ratio data of the light-emitting block based on the duty ratio data calculated from the duty ratio calculation part and the duty ratio data stored in the duty ratio storage part during the first period; and a signal generation part which generates the driving signal having the duty ratio corresponding to the determined duty ratio data to drive the light-emitting block.

6. The display apparatus of claim 5, wherein the compensation part generates the compensated pixel data using the predetermined high duty ratio of the predetermined duty ratio data.

7. The display apparatus of claim 6, wherein the predetermined duty ratio data is the duty ratio data of the light-emitting block when the duty ratio data of the light-emitting block is greater than or equal to the predetermined value during the first period, and the compensation part generates the compensated pixel data using the duty ratio data of the light-emitting block.

8. The display apparatus of claim 4, wherein the duty ratio corresponding to the determined duty ratio data to drive the light-emitting block at a moderate temperature is in a range of about 10% to about 50%.

9. A method of driving a light source device including a light source module divided into a plurality of light-emitting blocks, which are individually operated, the method comprising:

extracting representative luminance data of a light-emitting block of the plurality of light-emitting blocks by using pixel data corresponding to the light-emitting block;

calculating duty ratio data of the light-emitting block by using the representative luminance data;

generating a determined duty ratio of the light-emitting block based on the duty ratio data calculated from the duty ratio calculation part and the duty ratio data stored in a duty ratio storage part during a first period corresponding to a plurality of frames;

generating a driving signal having a duty ratio corresponding to the determined duty ratio data; and driving the light-emitting block using the driving signal, wherein said generating the determined duty ratio data comprises:

determining whether the duty ratio data is less than a predetermined value during the first period; and generating the determined duty ratio data as a high duty ratio for the light-emitting block during a second period corresponding to a plurality of frames, subsequent to the first period, when the duty ratio data is less than the predetermined value during the first period.

10. The method of claim 9, wherein said generating the determined duty ratio data further comprises generating the determined duty ratio data as duty ratio data when the duty ratio data is greater than or equal to the predetermined value during the first period.

11. The method of claim 9, wherein the duty ratio corresponding to the determined duty ratio data to drive the light-emitting block at a moderate temperature is in a range of about 10% to about 50%.

* * * * *